United States Patent [19]

Halter

[11] 4,148,696

[45] Apr. 10, 1979

[54] ELECTROCHEMICAL OXIDATION OF ACTIVATED ALKYL AROMATIC COMPOUNDS

[75] Inventor: Mark A. Halter, Arlington Heights, Ill.

[73] Assignee: UOP Inc., Des Plaines, Ill.

[21] Appl. No.: 888,702

[22] Filed: Mar. 20, 1978

[51] Int. Cl.[2] ..... C25B 3/02

[52] U.S. Cl. ..... 204/59 R; 204/79; 204/80; 260/604 R; 560/254; 562/409; 568/648

[58] Field of Search ..... 204/78, 79, 80, 72, 204/59 R

[56] References Cited

U.S. PATENT DOCUMENTS

| | | | |
|---|---|---|---|
| 2,110,273 | 3/1938 | McKee et al. | 204/78 X |
| 3,347,758 | 10/1967 | Koehl | 204/59 R |
| 3,714,003 | 1/1973 | Engelbrecht et al. | 204/78 |

FOREIGN PATENT DOCUMENTS

| | | | |
|---|---|---|---|
| 865740 | 2/1953 | Fed. Rep. of Germany | 204/79 |

OTHER PUBLICATIONS

Introduction To Organic Electrochemistry by Rifi et al., p. 312, Pub. by Marcel Dekker, Inc., N. Y., 1974.

*Primary Examiner*—F. C. Edmundson
*Attorney, Agent, or Firm*—James R. Hoatson, Jr.; Raymond H. Nelson; William H. Page, II

[57] ABSTRACT

The electrochemical oxidation of activated alkyl substituted aromatic compounds in which the alkyl substituent is acyloxylated in a direct oxidation process may be effected by treating an activated alkyl substituted aromatic compound with a fatty acid, an alkali metal or alkaline earth metal salt thereof and a phase transfer agent in an electrochemical cell to form oxidative products of the starting compound.

10 Claims, No Drawings

ELECTROCHEMICAL OXIDATION OF ACTIVATED ALKYL AROMATIC COMPOUNDS

BACKGROUND OF THE INVENTION

Heretofore the production of alkyl aromatic aldehydes or alcohols has been effected in a non-electrochemical process by treating the alkyl aromatic compound in a reaction vessel in an acidic media using multivalent transition metal catalysts, an example of which being cerium in a +4 valence state, at elevated temperatures ranging from about 50° to about 100° C. to form indirect oxidation products which are then converted to the desired compounds.

Likewise alkyl aromatic aldehydes or alcohols have also been produced by electrochemical generation of the activated transition metal species and combination of said species with the appropriate alkyl aromatic. However, the spent oxidant must be recovered and treated to return the transition metal to an activated state before it could be utilized in a second oxidative reaction process. Furthermore, in order to obtain the corresponding alcohol from the aldehyde the latter would have to be subjected to classical reduction methods in order to obtain the aforesaid alcohol.

As will hereinafter be set forth in greater detail, it has now been discovered that the obtention of alcohol, aldehyde and acid products may be obtained utilizing a direct electrochemical oxidation of activated alkyl substituted aromatic compounds.

This invention relates to a process for the electrochemical oxidation of alkyl substituted aromatic compounds. More specifically, the invention is concerned with a process for the electrochemical oxidation of activated alkyl substituted aromatic compounds to provide a direct oxidation in which the side chain, or alkyl substituent of the compound is acyloxylated.

Certain chemical compounds and especially those which contain two substituents in a position para to one another are useful in the chemical field. For example, anisic aldehyde (anisaldehyde) is useful in the perfume industry or as an intermediate for antihistamines. Likewise, anisic alcohol is also useful in the perfume industry for imparting light floral odors to the odoriferous composite while anisic acid is used in medicine, as a repellant and an ovicide. Heretofore, compounds such as this were prepared according to methods hereinbefore set forth. However, it has now been discovered that alkyl substituted aromatic compounds which are activated by the presence on the ring of activating substituents of the type hereinafter set forth in greater detail may be electrochemically oxidated in a process whereby the alkyl substituent on the ring undergoes oxidation to form aldehydes, alcohols and acids, thus obviating the necessity for treating intermediates which have been formed in other oxidation reactions to obtain the desired compounds.

It is therefore an object of the present invention to provide a process for the electrochemical oxidation of alkyl substituted aromatic compounds.

A further object of this invention is to provide a process for electrochemically oxidating alkyl substituted aromatic compounds which are in an activated state due to the presence of other substituents on the aromatic ring.

In one aspect an embodiment of this invention resides in a process for the electrochemical oxidation of an activated alkyl substituted aromatic compound which comprises subjecting said compound to an electrochemical oxidation in an electrochemical cell in the presence of a fatty acid, an alkali metal or alkaline earth metal salt thereof and a phase transfer agent comprising a symmetrical or asymmetrical tetraalkyl nitrogen or phosphorous base salt containing from 1 to about 20 carbon atoms in each chain, and recovering the resultant oxidative products.

A specific embodiment of this invention is found in a process for the electrochemical oxidation of an activated alkyl substituted aromatic compound which comprises subjecting p-methoxytoluene to an electrochemical oxidation in an electrochemical cell utilizing electrical energy which includes a voltage in the range of from about 2 to about 20 volts and a current density in the range of from about 20 to about 500 milliamps/cm$^2$ in the presence of propionic acid, sodium propionate and lauryltrimethylammonium chloride, and recovering the resultant anisic aldehyde and anisic alcohol.

Other objects and embodiments will be found in the following detailed description of the present invention.

As hereinbefore set forth the present invention is concerned with a process for the electrochemical oxidation of alkyl substituted aromatic compounds which are activated by the presence of an activating substituent on the ring, said oxidation resulting in the direct acyloxylation of the alkyl side chain rather than a nuclear acyloxylation. The electrochemical oxidation is effected by treating an activated alkyl substituted aromatic compound of the type hereinafter set forth in greater detail with a fatty acid and an alkali metal or alkaline earth metal salt thereof in the presence of a phase transfer agent in an electrochemical cell. By utilizing a combination of fatty acid, the salt thereof, water, organic solvent and phase transfer agent, it is possible to provide a favorable emulsion medium in which to effect the electrochemical oxidation of the compound.

In addition, it has also been discovered that by changing various operating conditions or parameters it is possible to control the formation of the reaction products. For example, when utilizing a decreased concentration of fatty acid ions, by utilizing a low concentration of the phase transfer agent as well as utilizing phase transfer agents which contain relatively short chain alkyl groups, that is, from about 1 to about 4 carbon atoms, it is possible to promote the formation of the aldehyde form of the reaction product. Conversely speaking, by utilizing a high concentration of fatty acid ions a high concentration of phase transfer agent as well as utilizing phase transfer agents in which the alkyl groups are relatively long chain moieties, that is, greater than about 5 carbon atoms in length, it is possible to promote the formation of the alcohol form of the reaction product.

Examples of alkyl substituted aromatic compounds which possess an activating substituent on the ring thereof will include those compounds having the generic formula

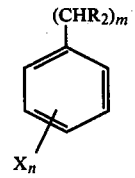

in which R is hydrogen or methyl radicals, X is independently selected from the group consisting of alkyl, alkoxy, hydroxy, primary amine, secondary amine, tertiary amine, benzyl and amide radicals, m is an integer of from 1 to about 4 and n is a radical of from 1 to 5 such as o-hydroxytoluene, m-hydroxytoluene, p-hydroxytoluene, o-methoxytoluene, m-methoxytoluene, p-methoxytoluene, o-ethoxytoluene, m-ethoxytoluene, p-ethoxytoluene, o-propoxytoluene, m-propoxytoluene, p-propoxytoluene, o-butoxytoluene, m-butoxytoluene, p-butoxytoluene, o-xylene, m-xylene, p-xylene, 1,2,3-trimethylbenzene, 1,3,5-trimethylbenzene, 1,2,4-trimethylbenzene, 1,2,3,4-tetramethylbenzene, pentamethylbenzene, o-ethyltoluene, m-ethyltoluene, p-ethyltoluene, o-n-propyltoluene, m-n-propyltoluene, p-n-propyltoluene, o-isopropyltoluene, m-isopropyltoluene, p-isopropyltoluene, o-n-butyltoluene, m-n-butyltoluene, p-butyltoluene, o-t-butyltoluene, m-t-butyltoluene, p-t-butyltoluene, o-hydroxyethylbenzene, m-hydroxyethylbenzene, p-hydroxyethylbenzene, o-methoxyethylbenzene, m-methoxyethylbenzene, p-methoxyethylbenzene, o-ethoxyethylbenzene, m-ethoxyethylbenzene, p-ethoxyethylbenzene, o-propoxyethylbenzene, m-propoxyethylbenzene, p-propoxyethylbenzene, o-butoxyethylbenzene, m-butoxyethylbenzene, p-butoxyethylbenzene, 1,2-diethylbenzene, 1,3-diethylbenzene, 1,4-diethylbenzene, 2-propylethylbenzene, 3-propylethylbenzene, 4-propylethylbenzene, 2-t-butylethylbenzene, 3-t-butylethylbenzene, 4-t-butylethylbenzene, 2-hydroxymethylnaphthalene, 3-hydroxymethylnaphthalene, 4-hydroxymethylnaphthalene, 2-methoxymethylnaphthalene, 3-methoxymethylnaphthalene, 4-methoxymethylnaphthalene, 2-ethoxymethylnaphthalene, 3-ethoxymethylnaphthalene, 4-ethoxymethylnaphthalene, 2-propoxymethylnaphthalene, 3-propoxymethylnaphthalene, 4-propoxymethylnaphthalene, 1,2-dimethylnaphthalene, 1,3-dimethylnaphthalene, 1,4-dimethylnaphthalene, 2-ethylmethylnaphthalene, 3-ethylmethylnaphthalene, 4-ethylmethylnaphthalene, 5-ethylmethylnaphthalene, o-toluidine, m-toluidine, p-toluidine, o-ethylaniline, m-ethylaniline, p-ethylaniline, o-isopropylaniline, m-isopropylaniline, p-isopropylaniline, o-n-butylaniline, m-n-butylaniline, p-n-butylaniline, o-methyl-N-methylaniline, m-methyl-N-methylaniline, p-methyl-N-methylaniline, o-methyl-N,N-dimethylaniline, m-methyl-N,N-dimethylaniline, p-methyl-N,N-dimethylaniline, o-methyl-N,N-diethylaniline, m-methyl-N,N-diethylaniline, p-methyl-N,N-diethylaniline, o-benzyltoluene, m-benzyltoluene, p-benzyltoluene, o-benzylethylbenzene, m-benzylethylbenzene, p-benzylethylbenzene, etc. It is to be understood that the aforementioned alkyl substituted aromatic compounds which contain an activating substituent on the ring thereof are only representatives of the class of compounds which may be employed, and that the present invention is not necessarily limited thereto.

The aforementioned activated alkyl substituted aromatic compounds are treated with a fatty acid which contains from 2 to about 5 carbon atoms including acetic acid, propionic acid, butyric acid, isobutyric acid, trimethylacetic acid, valeric acid, isovaleric acid, etc. Likewise, an alkali metal or alkaline earth metal salt of the acid such as sodium acetate, sodium propionate, sodium butyrate, sodium valerate, potassium acetate, potassium propionate, potassium butyrate, potassium valerate, calcium acetate, calcium propionate, barium butyrate, barium valerate, etc., is also present. The alkali metal or alkaline earth metal salt may be added separately or, if so desired, the salts may be formed in situ by adding an alkaline compound such as sodium hydroxide, potassium hydroxide, lithium hydroxide, calcium hydroxide, magnesium hydroxide, etc., to the reaction medium thereby converting a portion of the acid which is present to the salt thereof. In addition to the presence of fatty acid and the corresponding alkali metal or alkaline earth metal salt thereof, the reaction is also effected in the presence of a phase transfer agent. In the preferred embodiment of the invention, these phase transfer agents will comprise symmetrical or asymmetrical tetraalkylnitrogen-based or phosphorous-based salts in which the alkyl radicals contain from 1 to 20 carbon atoms in the chain. Some specific examples of these phase transfer agents will include tetramethylammonium hydroxide, tetraethylammonium hydroxide, tetrapropylammonium hydroxide, tetrabutylammonium hydroxide, tetrapentylammonium hydroxide, tetrahexylammonium hydroxide, tetranonylammonium hydroxide, tetradecylammonium hydroxide, tetradodecylammonium hydroxide, butyltrimethylammonium hydroxide, hexyltrimethylammonium hydroxide, heptyltrimethylammonium hydroxide, decyltrimethylammonium hydroxide, dodecyltrimethylammonium hydroxide, hexadecyltrimethylammonium hydroxide, eicosyltrimethylammonium hydroxide, diethyldimethylammonium hydroxide, dipropyldimethylammonium hydroxide, dibutyldimethylammonium hydroxide, dihexyldimethylammonium hydroxide, didecyldimethylammonium hydroxide, tributylmethylammonium hydroxide, triheptylmethylammonium hydroxide, trinonylmethylammonium hydroxide, triundecylmethylammonium hydroxide, tripentadecylmethylammonium hydroxide, dibutyldiethylammonium hydroxide, dioctyldiethylammonium hydroxide, the corresponding sulfate, nitrate, chloride and bromide salts, etc.; tetramethylphosphonium hydroxide, tetrapropylphosphonium hydroxide, tetrapentylphosphonium hydroxide, tetranonylphosphonium hydroxide, tetradodecylphosphonium hydroxide, hexyltrimethylphosphonium hydroxide, decyltrimethylphosphonium hydroxide, hexadecyltrimethylphosphonium hydroxide, diethyldimethylphosphonium hydroxide, dibutyldimethylphosphonium hydroxide, didecyldimethylphosphonium hydroxide, triheptylmethylphosphonium hydroxide, triundecylmethylphosphonium hydroxide, dibutyldiethylphosphonium hydroxide, etc., the corresponding sulfate, nitrate, chloride and bromide salts, etc. It is to be understood that the aforementioned phase transfer agents are only representative of the types of agents which may be employed and that the present invention is not necessarily limited thereto.

If so desired, in addition to the aforementioned acids, salts, and phase transfer agents the emulsion system will also contain water and an organic solvent such as dichloromethane, diethylether, acetonitrile, etc.

The electrochemical cell in which the electrochemical oxidation of the activated alkyl substituted aromatic compound is effected may be of any variety which is well known in the art. The electrodes which are employed in the cell may be formed of any conductive material, the preferred electrodes in the process of this invention comprising a carbon anode and a stainless steel cathode, although it is also contemplated that other materials such as platinum may also be employed. The oxidation reaction is effected utilizing an electrical energy which includes a voltage within the range of from about 2 to about 20 volts and a current density in the range of from about 20 to about 500 milliamps/cm$^2$. By utilizing a water emulsion containing the components hereinbefore set forth such as the phase transfer agent, the acid, the salt thereof and the organic solvent, it will be possible to utilize a lower voltage and a current density thereby reducing the power cost which will be required to effect the electrochemical oxidation. The aforesaid components of the reaction mixture will generally be present in amounts ranging from about 0.01 to about 0.2 moles of activated alkyl substituted aromatic compound, from about 0.01 to about 0.8 moles of alkali metal or alkaline earth metal salt of the fatty acid, from about 0.02 to about 0.4 moles of fatty acid and about 0.015 moles of phase transfer agent per 100 cc of water. In addition, the operating conditions under which the electrochemical oxidation is effected will include temperatures in the range of from about 0° to about 100° C. and pressures in the range of from about 1 to about 10 atmospheres.

The process of this invention may be effected in any suitable manner and may comprise either a batch or continuous type operation. When a batch type operation is employed an emulsion which will include the activated alkyl substituted aromatic compound, the fatty acid, the alkali or alkaline earth metal salt thereof, water, the organic solvent and the phase transfer agent is charged to a flask which is provided with an overhead stirrer, reflux condenser and air purge tube as well as a bottom exit tube. The solution is then stirred and transferred from the flask to an electrochemical cell in a multi-pass recycle operation wherein the activated alkyl substituted aromatic compound is subjected to an electrochemical reaction for a predetermined period of time which may range from about 0.5 up to about 10 hours or more in duration, the electrochemical energy which is charged to the cell being within the range hereinbefore set forth. Upon completion of the desired residence time the mixture is withdrawn from the cell and subjected to conventional means of operation which may include decantation, washing, drying, fractional distillation, etc., whereby the desired products comprising aldehydes, alcohols and acids are separated from unreacted starting materials and recovered.

It is also contemplated within the scope of this invention that the electrochemical oxidation of the activated alkyl substituted aromatic compound may be effected in a continuous manner of operation. When such a type of operation is used the aforementioned components of the reaction mixture, namely, the activated alkyl substituted aromatic compound, fatty acid, its alkali metal or alkaline earth metal salt thereof, water, phase transfer agent and organic solvent are all continuously charged to an electrochemical cell which is maintained at the proper operating conditions of temperature and pressure, said preferred conditions including ambient temperature and atmospheric pressure. After cycling through the cell and being subjected to an electrical charge for a predetermined period of time, the effluent is continuously withdrawn and subjected to conventional means of separation similar in nature to those hereinbefore set forth whereby the desired products comprising the aldehydes, alcohols and acids are recovered while any unreacted activated alkyl substituted aromatic compound as well as the other components of the emulsion system are recycled.

The following examples are given to illustrate the process of this invention. However, it is to be understood that these examples are given merely for purposes of illustration and that the present invention is not necessarily limited thereto.

EXAMPLE I

In this example a mixture consisting of 24.40 grams (0.20 mole) of p-methoxytoluene, 0.40 mole of propionic acid, 105 grams of water, 0.76 mole of sodium propionate, 0.015 mole of lauryltrimethylammonium chloride, and 70 milliliters of methylene chloride were admixed in a flask provided with an overhead stirrer, reflux condenser and nitrogen purge tube. The solution, after being stirred, was transferred from the flask through a flow cell provided with Teflon walls, a graphite anode, and a nickel foil cathode. The electrical energy which was used consisted of an E applied voltage ranging from 13 to 15 volts along with about 2.0 amps while maintaining the current density at a rate of about 100 milliamps/cm$^2$. In addition, the reaction was run at ambient temperature and atmospheric pressure. The solution was passed through the cell and condenser and back to the cell by use of a pump. The reaction was run for a period of 3 hours at the end of which time a gas liquid chromatographic analysis disclosed a current yield of 8% anisic aldehyde, 34% of the propionate ester of anisic alcohol, 15% of the propionate ester of 2-hydroxy-4-methoxytoluene and less than 1% anisic acid. Analysis also disclosed that there had been a 48% conversion of the p-methoxytoluene for an 86.2% level of current efficiency.

EXAMPLE II

In this example the above experiment was repeated using identical amounts of reactants with the exception of having 0.03 moles of lauryltrimethylammonium chloride present in the reaction mixture. The emulsion system was treated after thoroughly admixing in a flow cell for a period of 5 hours at ambient temperature and atmospheric pressure using an E applied voltage of from 8 to 10 volts and 2.0 amps while maintaining the current density at about 100 milliamps/cm$^2$. As in the previous experiment the flow cell was provided with Teflon walls, a graphite anode, and a nickel foil cathode, there being 6.0 mm annular spacing of the electrodes. Analysis of the product disclosed a yield of 4.4% anisic aldehyde, 15.1% of propionate ester of 2-hydroxy-4-methoxytoluene, a 42.2% yield of the propionate ester of anisic alcohol and some anisic acid. In addition there had been a 48.2% conversion of the p-methoxytoluene and a current efficiency of 86.2%.

EXAMPLE III

In this example the treatment of p-t-butyltoluene in an emulsion solution containing isovaleric acid, sodium isovalerate, lauryltrimethylammonium chloride, methylene chloride and water in a flow cell utilizing an E applied voltage of about 10 volts along with 2.0 amps and a current density of about 100 milliamps/cm$^2$ for a period of 4 hours at ambient temperature and pressure will permit the recovery of p-t-butylbenzaldehyde and p-t-butylbenzylalcohol.

I claim as my invention:

1. A process for the electrochemical oxidation of an activated alkyl substituted aromatic compound which comprises subjecting said compound to an electrochemical oxidation in an electrochemical cell in the presence of a fatty acid, an alkali metal or alkaline earth metal salt thereof and a phase transfer agent comprising a symmetrical or asymmetrical tetraalkyl nitrogen or phosphorous base salt containing from 1 to about 20 carbon atoms in each chain, and recovering the resultant oxidative products.

2. The process as set forth in claim 1 in which said electrochemical oxidation is effected utilizing electrical energy which includes a voltage in the range of from about 2 to about 20 volts and a current density in the range of from about 20 to about 500 milliamps/$cm^2$.

3. The process as set forth in claim 1 in which said electrochemical oxidation is effected at a temperature in the range of from about 0° to about 100° C. and a pressure in the range of from about atmospheric to about 10 atmospheres.

4. The process as set forth in claim 1 in which said phase transfer agent is a tetraalkyl ammonium salt.

5. The process as set forth in claim 1 in which said phase transfer agent is tetraalkyl phosphonium salt.

6. The process as set forth in claim 4 in which said tetraalkyl ammonium salt is lauryltrimethylammonium chloride.

7. The process as set forth in claim 1 in which said fatty acid is propionic acid and said alkali metal salt is sodium propionate.

8. The process as set forth in claim 1 in which said fatty acid is isovaleric acid and said alkali metal salt is sodium isovalerate.

9. The process as set forth in claim 1 in which said activated alkyl substituted aromatic compound is p-methoxytoluene and said oxidative products are anisic aldehyde and anisic alcohol.

10. The process as set forth in claim 1 in which said activated alkyl substituted aromatic compound is p-t-butyltoluene and said oxidative products are p-t-butylbenzaldehyde and p-t-butylbenzylalcohol.

* * * * *